United States Patent [19]

Isaacs

[11] Patent Number: 4,464,082

[45] Date of Patent: Aug. 7, 1984

[54] CHILLED GAS PIPELINE INSTALLATION AND METHOD

[75] Inventor: Ralph M. Isaacs, Bellevue, Wash.

[73] Assignee: Northwest Alaskan Pipeline Company, Salt Lake City, Utah

[21] Appl. No.: 494,415

[22] Filed: May 13, 1983

[51] Int. Cl.[3] ..... E02D 19/14; F16L 1/00

[52] U.S. Cl. ..... 405/157; 62/260; 165/45; 138/32; 405/130

[58] Field of Search ..... 405/154, 157, 130; 165/45; 138/32; 62/260; 404/28, 31

[56] References Cited

U.S. PATENT DOCUMENTS

| | | | |
|---|---|---|---|
| 3,135,097 | 6/1964 | Scheinberg | 405/130 X |
| 3,650,119 | 3/1972 | Sparling | 405/157 X |
| 3,880,538 | 4/1975 | Burt et al. | 404/28 |
| 4,063,429 | 12/1977 | Wilson | 405/157 |
| 4,269,539 | 5/1981 | Hopke | 405/157 X |
| 4,334,801 | 6/1982 | Gray | 405/157 |
| 4,358,223 | 11/1982 | Jahns et al. | 405/157 |

FOREIGN PATENT DOCUMENTS

| | | | |
|---|---|---|---|
| 47905 | 5/1979 | U.S.S.R. | 405/157 |

*Primary Examiner*—Dennis L. Taylor

*Attorney, Agent, or Firm*—Mason, Fenwick & Lawrence

[57] ABSTRACT

A chilled-gas carrying pipeline installation in soil or rock zones with different heave properties is disclosed which includes an earth-covered buried steel pipe with insulation formed of high strength urethane or other material covering substantially the upper 300 peripheral degrees of the buried pipe; the bottom of the pipe is bare of insulation so that the insulation means provides sufficient resistance to heat flow from the earth above the pipe into the pipe to permit the earth above the pipe to thaw from the surface down to about the horizontal diameter of the pipe during the warm season. The buried pipe is consequently substantially unrestrained against upward movement caused by freezing of the soil in active areas beneath the pipe so that the pipe is subjected to minimum strain or relieves substantially any strain accumulated during the previous cold season.

19 Claims, 8 Drawing Figures

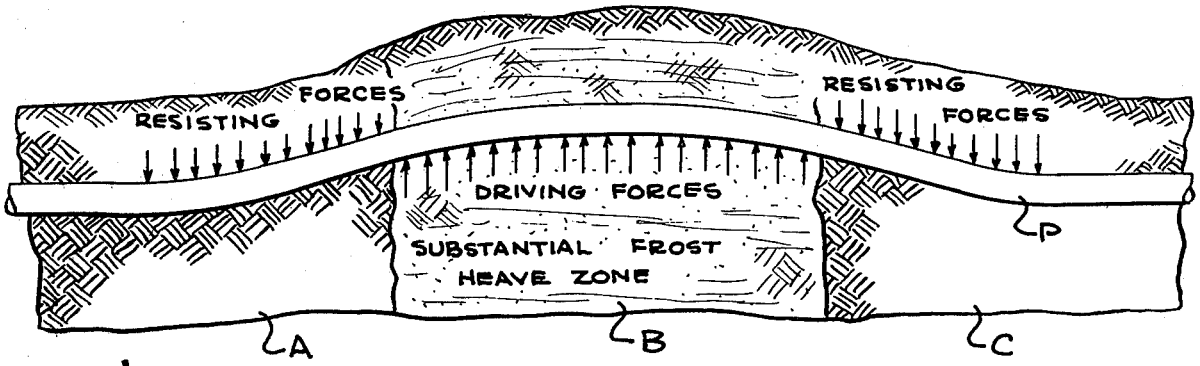
Fig-1
Fig-7
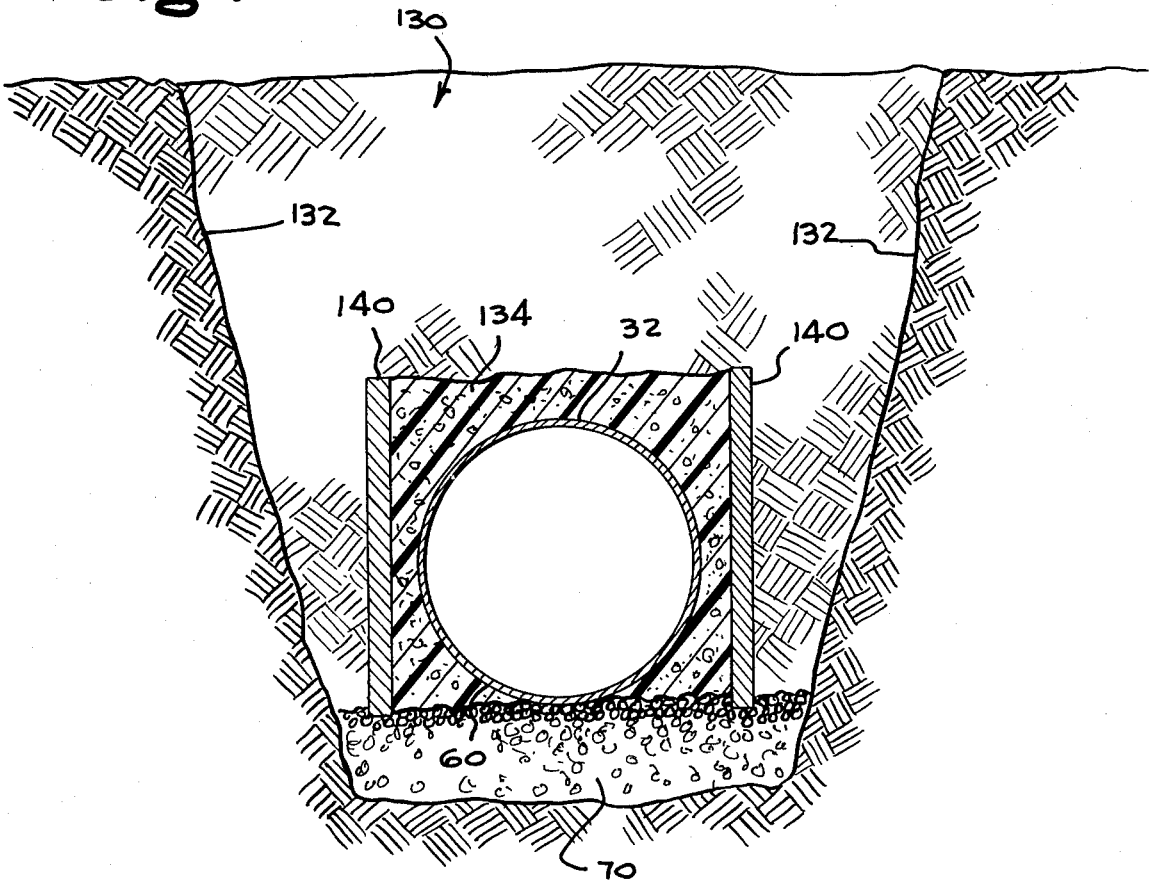

Fig-1-A
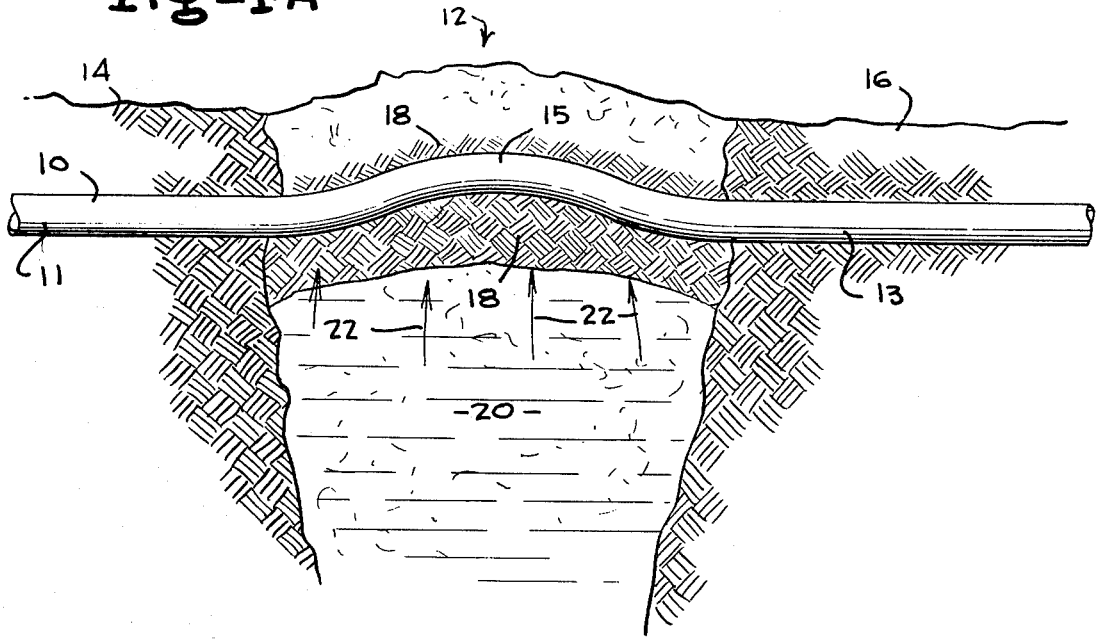
Fig-2
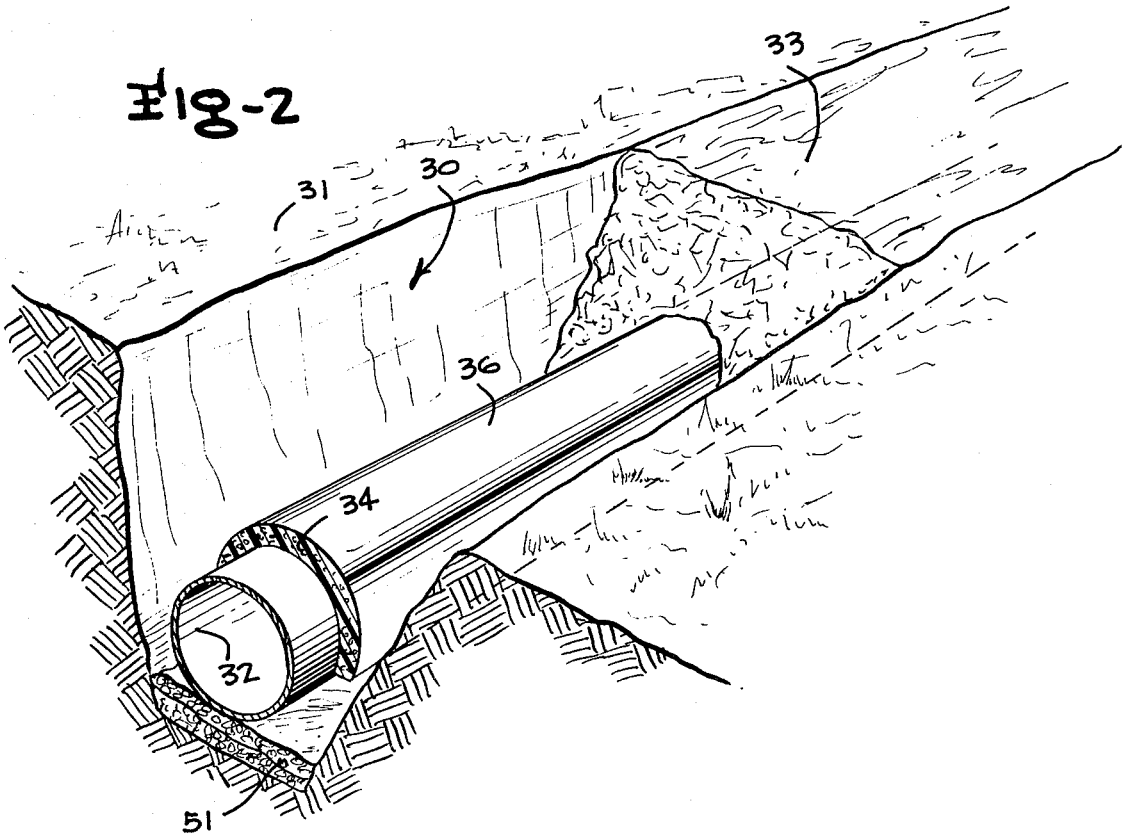

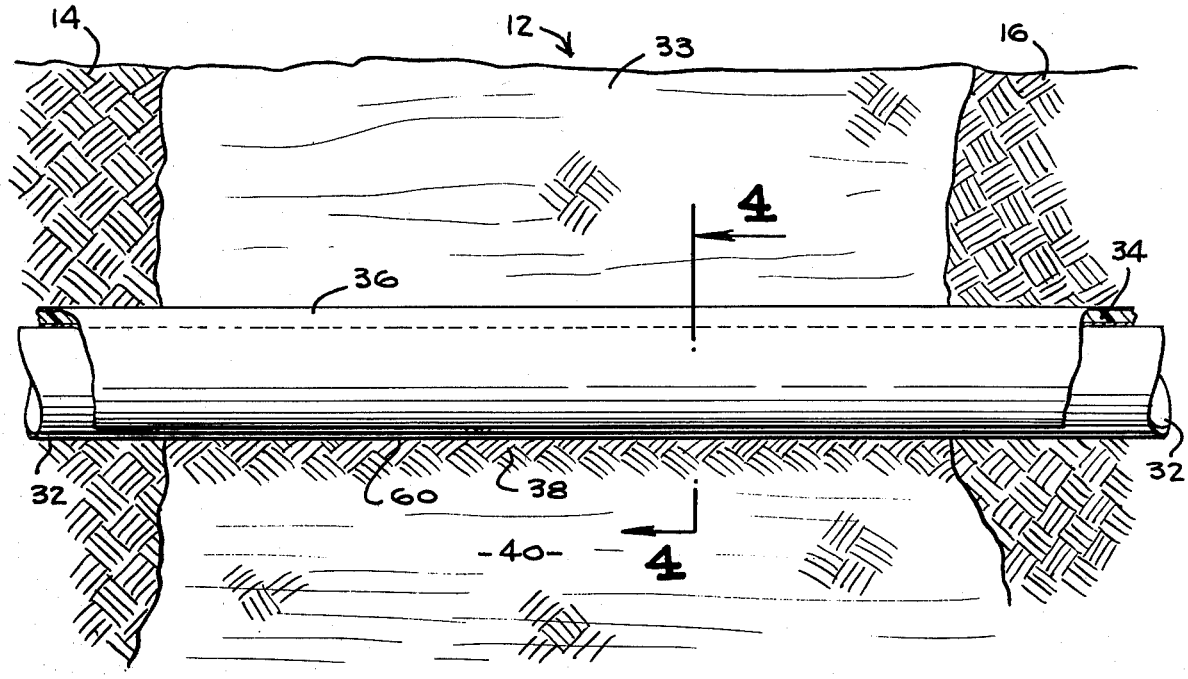
Fig-3
Fig-4
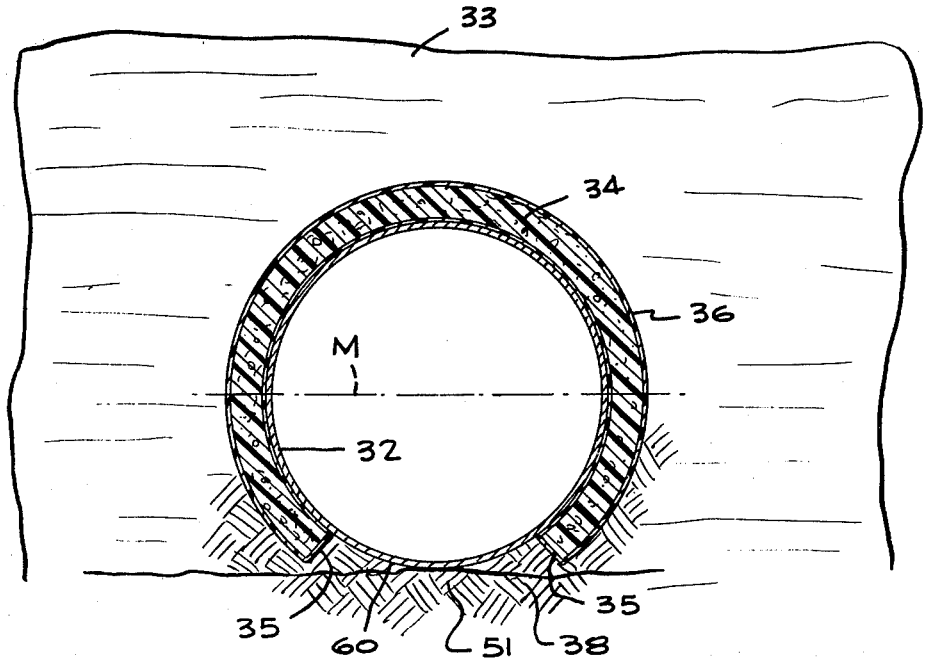

CHILLED GAS PIPELINE INSTALLATION AND METHOD

BACKGROUND OF THE INVENTION

The present invention is in the field of underground pipelines and is more specifically directed to a pipeline installation in areas in which the pipeline extends through adjacent soil zones having different frost heave driving forces and different resistive forces opposing the upward frost heave forces. The invention is of particular value in arctic and sub-arctic areas in which permafrost frozen soil conditions exist on a year-round basis at varying depths beneath the soil surface. However, it should also be understood that use of the present invention is not limited to permafrost areas and the benefits of the invention are achievable in any installation in which a chilled gas pipeline traverses alternate zones having different freeze and heave characteristics. Thus, the present invention relates to a method and structure for reducing forces exerted on a buried chilled gas pipeline extending through permafrost or other zones having different freezing and heaving characteristics which could create excessive force on the pipeline causing a hazardous likelihood of damage or rupture thereof.

A better understanding of the problems to which the present invention is addressed will be achieved by reference to FIG. 1 of the drawings which illustrates a pipeline P extending through a soil zone B having substantial frost heave and adjacent soil zones A and C having less frost heave; pipeline P is consequently subjected to differential heaving forces which, if of sufficient magnitude, could rupture the pipeline. Soil zone B having substantial frost heave attempts to push the pipe upward through the lesser heaving adjacent soil zones A and C. Resistance to the upward movement by the lesser heaving soil zones A and C is referred to as uplift resistance and it is the forces generated by the oppositely acting frost heave driving forces in zone B and uplift resistance forces in zones A and C which can create a hazardous likelihood of pipe failure.

The foregoing problems are most acute in arctic regions where a mixture of soil, rock, and ice, which is referred to as permafrost, remains in essentially permanently frozen condition downwardly from a depth a few feet below or near the surface. The surface soil layer above the permafrost layer is subjected to alternate thawing and freezing during the warm and cold seasons. However, discontinuous permafrost areas occur in which a thawed "active" area will be positioned between permanently frozen areas and will extend downwardly to bedrock or to a thaw line at a greater depth than the surface thawed portions of adjacent surface soil layers. The problems of maintaining structural integrity and stability by reducing the strain resultant from the differential heave forces are particularly acute for pipelines in such circumstances. A chilled gas pipeline carrying gas at below freezing temperatures is susceptible to frost heave forces since a frost bulb buildup around the pipe will in some soils attract additional moisture so as to increase the differential frost heave forces exerted on the pipe.

Soviet Pat. No. 361,349 discloses a pipeline having insulation about the lower half of the pipe apparently for the purpose of reducing pipe stress by reducing the growth of the frost bulb below the pipe and hence the frost heave forces. It would appear that the pipe disclosed in this patent is a liquid pipeline. German Pat. No. 497,118 also discloses a pipeline having varying amounts of insulation about different surfaces.

Devices, which have been somewhat misleadingly referred to as "heat pipes", such as exemplified in U.S. Pat. No. 3,217,791, have comprised a sealed pipe having a quantity of low boiling point liquid on their interiors. Such pipes have been embedded in the soil with their upper ends extending into the atmosphere. In such devices, the transfer of the heat to the colder atmosphere is effected by the change of state of the low boiling point liquid provided in the bottom of the pipe which absorbs heat from the surrounding soil and evaporates so that vapors move to the top of the pipe wherein the vapors are cooled by the surrounding cooler atmosphere and condensed to flow back to the bottom of the pipe in a continuous cycle of operation.

U.S. Pat. Nos. 4,194,856 and 4,269,539 disclose the employment of heat pipes positioned either adjacent to or beneath a refrigerated gas pipeline for aiding in the maintaining of a frozen condition beneath the pipeline so as to avoid the creation of excessive forces on the pipeline. These patents also include an extensive prior art discussion to which attention is particularly invited. Other known prior art includes U.S. Pat. Nos. 3,563,825; 3,747,355; 3,807,183; 3,809,149; 3,948,313 and 3,990,502.

Unfortunately, the prior known systems for controlling frost heave of pipelines have been unsatisfactory in performance and/or have been extremely expensive to manufacture and/or maintain.

Therefore, it is the primary object of the present invention to provide a new and improved method and apparatus for avoiding frost heave damage to a pipeline.

An even more particular object of the invention is the provision of a new and improved apparatus and method for preventing frost heave damage to chilled gas pipelines.

A still further object of the present invention is the provision of a new and improved apparatus and method for preventing damage to chilled-gas pipelines passing across different soil zones having different freezing and frost heave characteristics.

SUMMARY OF THE INVENTION

The present invention achieves the foregoing objects through the provision of a unique chilled gas pipeline construction embodying entirely different principles of operation from those of the prior art, which rely upon devices to pre-freeze the soil beneath the pipe so as to limit the differential heave or which rely on the use of insulation to restrict frost bulb growth beneath the pipe and limit the attendant differential heave. More specifically, the present invention is based upon the unique theory of reducing the resisting forces in the soil zones adjacent to a substantial heave zone so as to reduce consequently differential forces on the pipe. This result is achieved by permitting downward thawing to the pipeline from the surface of the soil layer above the pipeline during the warm season so that the resistance becomes equal to that of unfrozen soil rather than a mixture of frozen and unfrozen soils or frozen soils only with the result that the pipeline moves upward in this zone substantially reducing any strain in the pipe that had developed prior to thawing. The design limit on strain will consequently not be reached. Although the pipe may move upward if the heave force is sufficiently large, this is not a serious problem since the pipe can be relatively easily provided with an additional layer of covering soil or gravel.

In practice, the present invention is enabled by providing a buried chilled gas pipeline in a trench with the upper portion of the pipe being covered with insulation. Insulation in the form of high strength urethane foam or other high strength material covers the upper half of the pipe and extends below the middle of the pipe a substantial distance on both sides of the pipe and is held in position by mastic and/or straps or other conventional means. A protective coating of polyurethane or other material can be provided over the insulation for protecting the insulation and preventing the entry of water therein. The insulation over the upper portion of the pipe prevents the chilled gas on the interior of the pipe from keeping the soil above the pipe from thawing during the warm season, whereas the lack of insulation on the lower portion of the pipe permits the sub-zero gas in the pipe to maintain a year-round permanent frost bulb beneath all portions of the pipe. Thus, the already frozen zones of soil (permafrost) are maintained in a frozen condition preventing settlement of the pipe due to thawing. However, the fact that the soil overlying the pipe in the less heave inclined areas is not frozen (due to its physical character and the insulation over the upper portion of the pipe) results in reduced resisting forces which permit sufficient vertical movement of the pipe to preclude excessive differential forces and strain on the pipe. Note that this method is not intended to prevent heave from occurring due to the formation of a frost bulb around the chilled gas pipeline but rather to reduce the restraint on movement of the pipeline during the summer months so as to relieve substantially any accumulated strain.

A better understanding of the manner in which the objects of the invention are achieved will be enabled when the following detailed description is read in conjunction with the appended drawings which employ the same reference numerals for the same parts in the different figures.

BRIEF DESCRIPTION OF THE DRAWINGS

FIG. 1 is a sectional view illustrating forces acting on a pipeline traversing an intensive heave zone between adjacent less heave intensive soil zones;

FIG. 1A is an enlarged, more detailed sectional view of a chilled gas pipeline traversing an active frost heave zone sandwiched between adjacent zones having less frost heave characteristics;

FIG. 2 is a perspective view illustrating the preferred embodiment of the invention both in terms of the method and the structural aspects thereof;

FIG. 3 is an elevational view of a pipeline installation embodying the preferred embodiment as shown in partial section;

FIG. 4 is a sectional view taken along lines 4—4 of FIG. 3;

FIG. 7 is a transverse section of a ditch and pipe illustrating an alternative method of providing insulation on the pipe.

DESCRIPTION OF THE PREFERRED EMBODIMENTS

Figure 5:
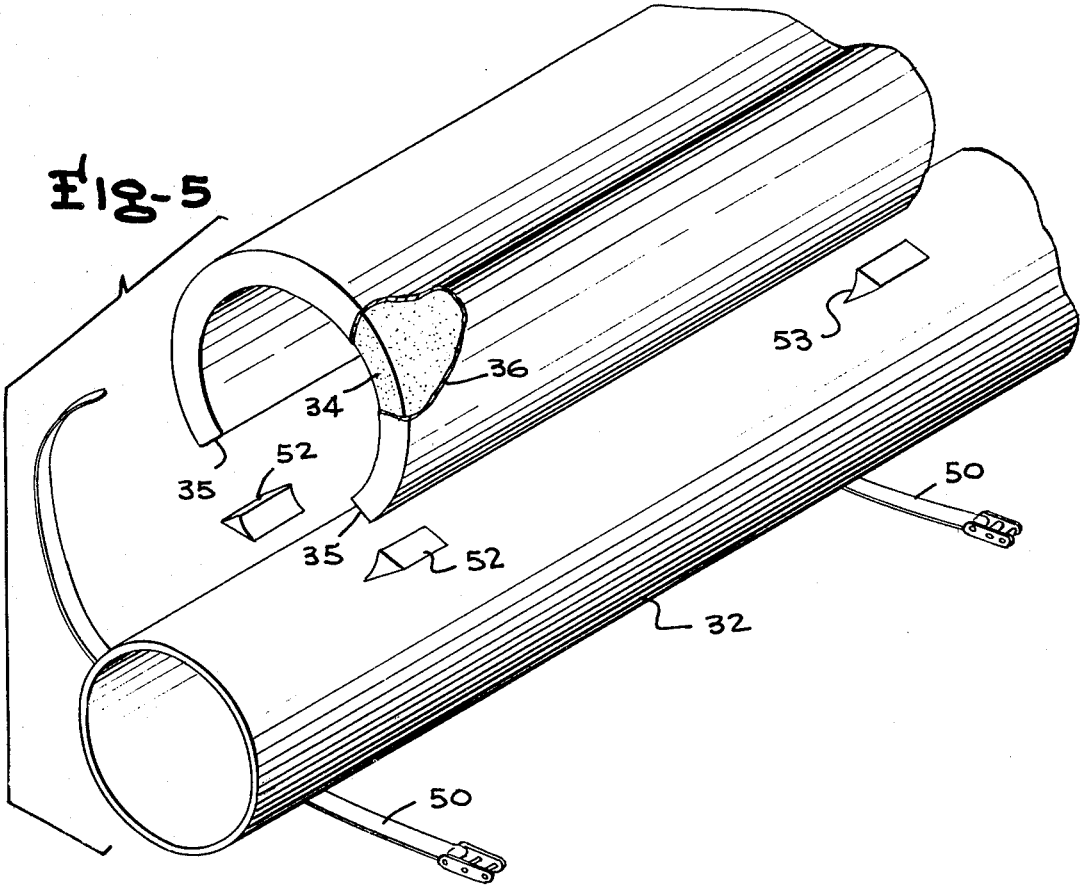
FIG. 5 is a perspective view of a second embodiment of the invention illustrating the steps in the assembly thereof.

Attention is initially invited to FIG. 1A which illustrates the forces acting on a conventional uninsulated chilled-gas pipeline 10 extending across a frost heave intensive unfrozen zone 12. More specifically, a buried pipeline 10 is shown with a central portion 15 extending across an unfrozen heave intensive zone 12 positioned between zones 14 and 16 which create less heave during freezing than occurs in zone 12. In the winter, freezing of zones 12, 14, and 16 will occur from the surface as well as from the chilled-gas pipeline. The pipe in zone 12 moves upwardly more quickly than in zones 14 and 16 and "end" portions 11 and 13 of the pipeline are effectively locked in zones 14 and 16 because of the high restraining forces from the frozen soil above the pipe. It should be observed that the chilled gas on the interior of the pipeline results in the buildup of a permanent frost bulb 18 of soil and water surrounding the pipe in zone 12, 14, and 16. Since the "ends" 11 and 13 of the pipe are held by the frozen zones 14 and 16 and cannot move vertically (or move vertically at a slower velocity than occurs in zone 12), great resisting forces are created in zones 14 and 16. It is consequently possible that damaging strain will be placed on the pipe so as to cause it to bow upwardly as shown in exaggerated form in FIG. 1A. It is the precise purpose of the present invention to mitigate the conditions illustrated in FIG. 1A by reducing the resisting forces in zones 14 and 16; however, it should be understood that usage of the present invention is not restricted to arctic or sub-arctic areas having permafrost and the invention is usable in any area in which one soil or rock has greater frost heave than those of adjacent soils or rocks.

In the practice of the present invention, a trench 30 is dug to a predetermined depth as shown in FIG. 2 and is provided with gravel or sand bedding or native soil 51 for receiving a steel pipe 32 having a thin coating of corrosion-preventing material (not shown) about its outer surface. The pipe is also provided with insulating means 36 extending over its upper surface. The insulating means extends below the medial plane M of the pipe 32 with the bottom surface 60 of the pipe between the lower ends 35 of the insulation 34 being un-insulated as shown in FIG. 4 so as to permit heat flow through the un-insulated surface to the interior of the pipe from the adjacent soil areas contacting the un-insulated area. The angular extent of the un-insulated area 60 about the periphery of the pipe will vary for different installations; however, for arctic installations, it would normally be approximately 60 degrees. A covering 33 of earth is provided over the pipe and insulating means.

The insulating means comprises a segment of a cylinder 34 of insulating material over which a protective coating 36 of urethane or other conventional material is optionally provided for preventing the entry of moisture into the insulating material and for reducing the likelihood of physical damage to the insulating material. The insulating material can be high strength foamed urethane having structural integrity when subjected to pressure in the order of at least 300 psi. However, other even stronger insulating materials such as syntactic foams, foamed concrete, foamed glass and the like having high compressive strength could also be used.

The periphery of the pipe covered by insulation is selected so that during the warmer summer season thawing will occur from the surface 31 to approximate level of the medial plane M of the pipe 32. Since the pipe carries a chilled gas at a temperature well below the freezing temperature of water, the chilled gas passing through the pipe would tend to maintain a frozen condition in all portions of the earth contacting the uninsulated portions of the pipe.

FIG. 3 illustrates a typical installation of the inventive system in which the pipe 32 extends across an unfrozen zone 12 positioned between permafrost zones 14 and 16. Thus, the pipe extends through a discontinuous permafrost zone. In the summer months, the insulating material 34 prevents the chilled gas in the pipe from maintaining a frost bulb over the upper half of the pipe; however, a downwardly extending frost bulb 38 is resultant from heat absorption by the gas in the pipe from the soil beneath the uninsulated bare portion 60 of the pipe in the active zone 12. Stated differently, the insulation permits the soil above the insulation to thaw downwardly from the surface approximately to the medial plane level of the insulation so that areas 14 and 16 above the pipe cannot provide substantial heave resisting forces against the heave forces which occur in zone 12. If it were not for the presence of the insulation 34, the sub-freezing gas in the pipe would maintain a frozen condition in the soil in areas 14 and 16 above the pipe so as to lock fixedly the pipe in position to create possibly unacceptable differential forces on the pipe. Upon the return of cold weather, zones 12, 14, and 16 will refreeze, locking in the pipe in zones 14 and 16 and generating additional strain in the pipe due to the heaving forces in zone 40. But in the following summer, this strain will be substantially relieved by the thawing of the soil above the pipe causing substantially reduced resistance to movement in zones 14 and 16. However, since the ends of the pipe in the permafrost zones 14 and 16 are not fixedly held by the soil above the pipe, there is only a small amount of resistive force and a certain amount of upward movement of the pipe is permitted so as to preclude excessive strain on the pipe. Damage to the pipe will consequently be avoided.

Figure 6:
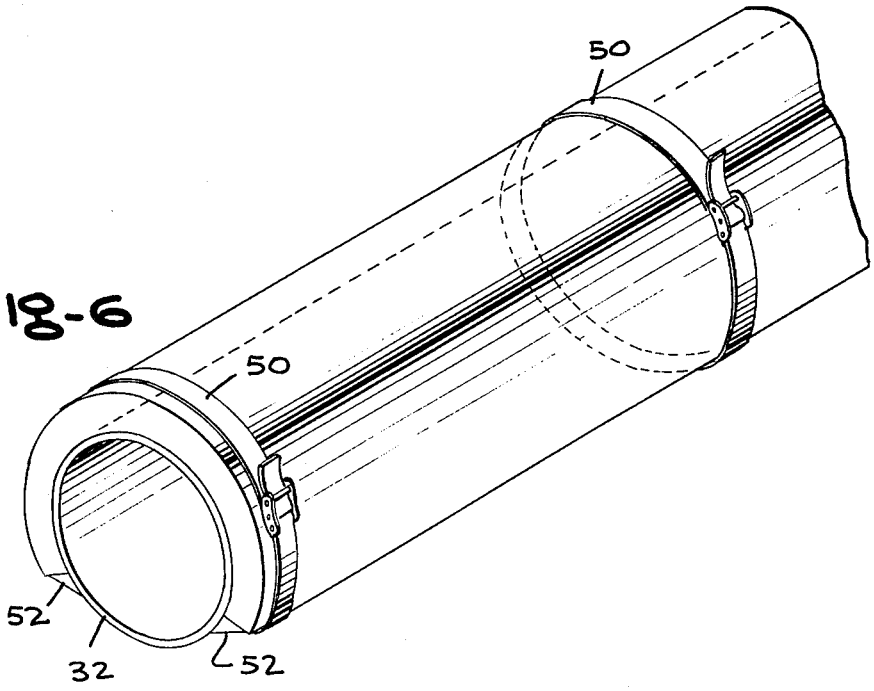
FIG. 6 is a perspective view of the embodiment of FIG. 5 in assembled condition.

FIGS. 5 and 6 illustrate a second embodiment of the invention in which the insulating material in the form of cylinder sections of foam insulation are held in position by fiberglass straps or belts 50 extending about the pipe and the foam bodies as best shown in FIG. 6. Optional stress absorbing blocks 52 formed of foam or other material can be provided beneath the strap members 50 on the lower surface of the pipe for reducing the force on the lower edge 54 of the foam members in an obvious manner. The blocks 52 can be integrally formed with the foam bodies 34 if desired. Also, it would be possible to form the foam members or blocks 34 as separate components divided along a vertical plane extending through the center line of the foam blocks to permit the initial positioning of the foam members on the pipe 32. Also, in some instances it would be possible to bend the lower edges of the cylinder sections apart a distance sufficient to permit the form to be "snapped" in position.

It should also be understood that the insulation material can be sprayed on the pipe after it is laid in the ditch or can be cast about the pipe in the ditch. FIG. 7 illustrates one such method of casting the insulation in place on a pipe 32 positioned on a pillow 70 of gravel or the like provided in the bottom of a ditch 130 having walls 132. Forms 140 are provided along opposite sides of the pipe and insulating material 134 is poured to fill the form and cover completely the pipe while leaving bare portion 60 as shown. Alternatively, forms 140 can be eliminated and the insulating material poured in the ditch to fill simply the space between the walls 132 of the ditch to a desired level.

Thus, it will be seen that the present invention represents a substantial step forward in the art by preventing excess strain on a chilled gas pipeline in a remarkably simple, yet effective, manner. While preferred embodiments of the invention have been disclosed, it should be understood that the disclosed embodiments will undoubtedly be susceptible to modifications by those of skill in the art, and it should be understood that the scope of the invention is to be limited solely by the appended claims.

I claim:

1. A chilled media carrying pipeline installation comprising an earth-covered buried pipe member and insulation means covering the upper half and a portion of the lower half of the buried pipe member, the lowermost bottom portion of the buried pipe member being bare of insulation means, and wherein the insulation means provides sufficient resistance to heat flow from the earth above the pipe into the pipe to permit the earth above the insulation means to thaw from the surface down to the insulation means during periods of warm weather while chilled media flowing through said buried pipe member maintains the area immediately beneath the pipe in a permanently frozen condition.

2. The invention of claim 1 wherein said pipe member is formed of metal and the insulation means comprises a body of urethane foam.

3. The invention of claim 1 wherein said pipe member is formed of steel and said insulation means comprises a body of urethane foam in the shape of a section of a cylinder and further including a coating of polyurethane provided over the outer surface of said body of urethane foam.

4. The invention of claim 1 wherein said lowermost bottom portion of the pipe that is bare of insulating material extends over approximately 60 degrees of the pipe periphery.

5. The invention of claim 1 wherein said pipe member is formed of steel and said insulation means comprises a body of insulation material poured and cast in place about upper portions of said pipe member.

6. The invention of claim 5 wherein said body of insulation material extends across the entire width of a ditch in which the pipe is positioned.

7. The invention of claim 5 wherein the body of insulating material extends over approximately 300 degrees of the periphery of the pipe.

8. The invention of claim 1 wherein said insulation means comprises high strength foamed urethane having structural integrity when subjected to pressures of 300 or more psi.

9. The invention of claim 8 wherein said insulating means covers approximately the upper 300 degrees of the periphery of the pipe.

10. The invention of claim 1 wherein said insulation means is a syntactic foam.

11. The invention of claim 1 wherein said insulation means is foamed glass.

12. The invention of claim 1 wherein said insulation means is foamed concrete.

13. In a pipeline containing chilled gas extending across a frost heave intensive zone and adjacent zones having less frost heave, the improvement comprising insulation means covering the upper portion of the pipe for substantially inhibiting the transfer of heat through the upper portion of the pipe from a covering of soil overlying the thermal insulation means to reduce frost heave resisting forces in the adjacent zones by permitting the thawing of the covering soil in said adjacent zones during the summer months.

14. A pipeline installation as recited in claim 13 wherein said insulation means comprises a body of high strength foam.

15. A pipeline installation as recited in claim 13 wherein said adjacent zones comprise first and second permafrost zones and said frost heave intensive zone comprises an initially unfrozen zone.

16. A method of minimizing strain on an earth-covered buried chilled gas pipeline extending through adjacent soil or rock zones having different frost heave characteristics, said method comprising the steps of:

(1) maintaining the flow of chilled gas through the pipeline so as to maintain a chilled soil condition in areas immediately adjacent and beneath the pipeline; and (2) substantially precluding the absorption of heat by the pipeline from the earth covering above the pipeline so as to permit the earth covering above the pipeline to thaw naturally during the warm season so as to minimize resistance to upward force on the pipeline resultant from freezing of areas beneath the pipeline.

17. The method of claim 16 wherein step (2) is effected by providing insulation material about the upper portion of the pipeline.

18. The method of claim 16 wherein step (1) maintains frozen soil conditions in areas immediately beneath and adjacent the pipeline.

19. The method of claim 17 wherein step (1) maintains frozen soil conditions in areas immediately beneath and adjacent the pipeline.

* * * * *